United States Patent [19]

Moore et al.

[11] Patent Number: 4,488,589

[45] Date of Patent: Dec. 18, 1984

[54] SHOT CYLINDER CONTROLLER

[75] Inventors: James I. Moore, Zeeland; Philip J. Van Huis, Holland, both of Mich.

[73] Assignee: Ex-Cell-O Corporation, Troy, Mich.

[21] Appl. No.: 331,350

[22] Filed: Dec. 16, 1981

[51] Int. Cl.[3] ..... B22D 17/32

[52] U.S. Cl. ..... 164/155; 164/457

[58] Field of Search ..... 164/4.1, 113, 155, 312, 164/457

[56] References Cited

U.S. PATENT DOCUMENTS

| | | | |
|---|---|---|---|
| 3,726,334 | 4/1973 | Sallberg | 164/155 |
| 4,252,176 | 2/1981 | Page | 164/155 |
| 4,330,026 | 5/1982 | Fink | 164/457 |

FOREIGN PATENT DOCUMENTS

| | | | |
|---|---|---|---|
| 0131062 | 10/1981 | Japan | 164/155 |

*Primary Examiner*—Kuang Y. Lin

*Attorney, Agent, or Firm*—John C. Evans

[57] ABSTRACT

A die casting machine has a hydraulic shot ram controlled by a servo system that includes pre-settable thumbwheel switches to establish a desired memory of shot speed values and shot position presets in a programmable computer. An analog output responsive to the control program in the programmable computer produces a direct current analog velocity command signal. A servo amplifier includes means for comparing the command analog signal and a feedback signal from transducers sensing velocity of the hydraulic ram and position of valve means to produce an on-off servo valve signal so that a servo valve will modulate flow from a third state Olmsted shot valve so as to compensate for shot speed changes produced by changes in operational conditions including wear and build-up on a cylinder and ram; hydraulic oil heat-up during operation of the machine; and changes in flow characteristics of a molten metal due to temperature variations thereof.

1 Claim, 7 Drawing Figures

SHOT CYLINDER CONTROLLER

TECHNICAL FIELD

This invention relates to servo systems for controlling die casting machines and more particularly to a servo system for controlling the operation of a shot cylinder for a die casting machine.

BACKGROUND OF THE INVENTION

Prior control systems have included in-line hydraulic controls for regulating the speed of a shot cylinder of a die casting machine. The valve components of such systems are susceptible to dirt particles. They require a flow sensor in the hydraulic line to sense the hydraulic flow that drives the hydraulic shoot ram and a feedback signal of variations in the in-line hydraulic flow is sensed for regulating ram speed. Periodic maintenance of such hydraulic systems is more involved because of the presence of such complex control components in the hydraulic flow stream.

Other controllers have included a position transducer located inside the cylinder of a hydraulic shot cylinder to control the position of the ram for a slow shot or a fast shot. Such controllers do not include velocity feedback functions to compensate for changes of operating variables which result from changes in the fluid mechanics of the system.

SUMMARY OF THE INVENTION

An object of the present invention is to provide an improved servo controlled shot cylinder for a die-casting machine including a quick response linear displacement transducer for producing a signal of shot ram velocity and further including programmable means for comparing the actual shot ram velocity with a command velocity signal and still further including means operative to cycle a hydraulic servo valve to on-off states thereby to produce modulation of flow from a hydraulic shot valve to compensate for changes in velocity produced by operating variances in the fluid mechanics of the system.

Yet another object of the present invention is to provide a system of the type set forth in the preceding object including presettable means for producing binary coded decimal data and input module means for sending a binary coded decimal signal to a programmable computer and wherein the digital signal is directed in accordance with a preselected computer program to an output module with a binary coded signal which is converted by a digital to analog converter card to a linear analog command signal compared to the output from a ram position velocity transducer wherein the transducer produces two individual DC outputs, one for the ram position of the shot cylinder and the other for the velocity of the shot cylinder ram and wherein the velocity signal is directed to a servo amplifier circuit for feedback and wherein the position signal is sent to an analog input module and converted to a binary coded signal for use in the control program of the programmable computer.

The programmable shot control of the present invention includes thumbwheel switches that will preset slow shot velocity, fast shot velocity, low impact velocity, follow through velocity, shot retract velocity and start intensifier velocity values in the memory of a programmed computer; the velocity settings are correlated to the percentage of flow through a main shot hydraulic control valve. A quick response electronic velocity feedback is provided to a pilot valve amplifier so as to prevent dirt or mechanical component wear from affecting hydraulic control system efficiency. A desired velocity command signal and an actual hydraulic ram feedback signal are processed by amplifier circuit means that produce a two level output signal which either turns a servo valve on or off. The on-off controlled servo valve produces hydraulic pulses that will produce continuous modulation of flow from a shot valve for supplying a hydraulic fluid flow to the ram drive of a shot cylinder to adjust its velocity to compensate for changes in the dynamic characteristics (fluid mechanics) of the injected metal.

These and other objects and features of the present invention will be apparent to those skilled in the art to which it relates from the following description made with reference to the accompanying drawings.

BEST MODE FOR CARRYING OUT THE INVENTION

Figure 1:
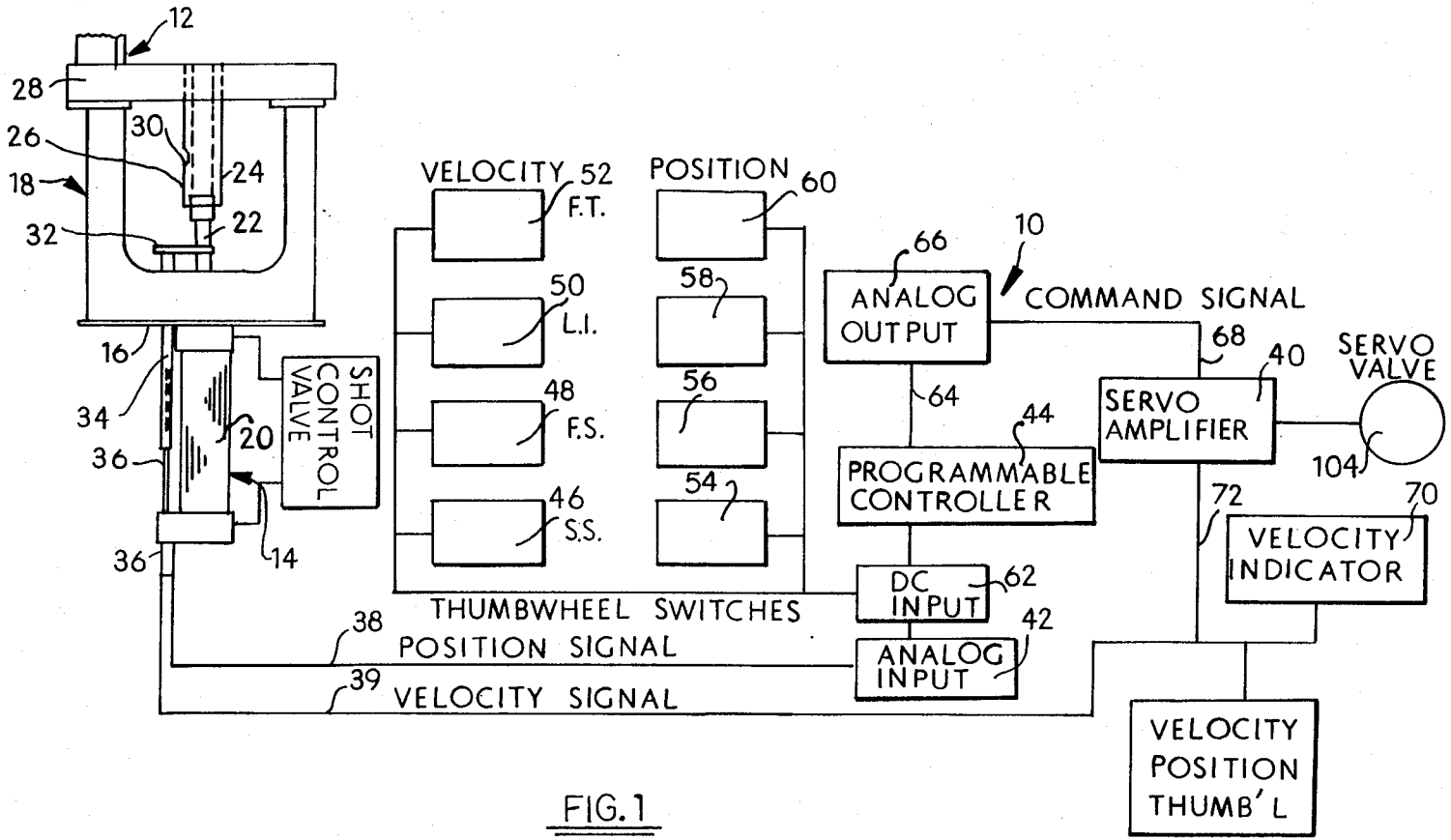
FIG. 1 is a block diagram of a programmable shot cylinder control system including the present invention.

Referring now to FIG. 1, a programmable shot cylinder controller 10 is shown in association with a die casting machine 12 of the type more specifically set forth in U.S. Pat. No. 4,064,928 issued Dec. 27, 1977 to Wunder for Die Casting Machine.

The machine 12 includes a shot assembly 14 mounted on a vertical face plate 16 of a C-frame bracket 18. The shot assembly includes a hydraulically operated shot cylinder 20 that drives a reciprocable output ram 22 which reciprocates in a shot chamber 24 (usually referred to as a "cold chamber") in a cylinder 26 mounted on a front plate 28 of the machine. Molten metal such as aluminum is poured into an inlet 30 of the cold chamber and the ram is reciprocated to force the liquid metal into a die cavity.

A carriage 32 connected to ram 22 drives a movable position indicating tube 34 with respect to a linear displacement transducer 36 which produces a DC output signal on line 38 indicating the position of the ram 22 and a DC output signal on line 39 indicating the velocity of ram 22 during programmed operation of the machine. The velocity signal is directed to a pilot valve amplifier circuit 40 for closed loop velocity control of the machine. The position signal is directed to an analog input module 42 of a programmable controller 44. The programmable controller 44 includes an Allen-Bradley processor module catalogue number 1772-LN2 or LN3 that examines data from input devices connected to its input and output. The module compares input/output data with a user control program to control the shot cylinder speed to compensate for changes in the temperature of hydraulic fluid in the machine and other operating variables which can affect the finished casting. More particularly, in the illustrated machine two distinct but related systems are present including (1) the molten metal to be cast and (2) the machine shot mechanism. The present invention produces an on-going analysis of the behavior of the shot cylinder which in turn reflects the dynamic characteristics of the metal flow and the resultant character of the finished casting.

The memory of the programmable controller is set by velocity control thumbwheel switches 46,48,50,52 for slow shot velocity, fast shot velocity, low impact velocity and follow through velocity respectively. The velocity control switches are used to preset shoot speed values into the memory of controller 44. Additional presettable memory is established by position control thumbwheel switches 54,56, 58,60 for setting shot retracted position, fast shot position, low impact position and start intensifier position.

Each thumb wheel switch is a rotating numeric switch that inputs values for the speed and position functions. Each switch is graduated from 000 to 999 which corresponds to the desired percentage of total shot stroke and total shot velocity.

A DC input module 62 receives binary coded decimal information from the thumbwheel switches and sends it to the central processor of the programmable controller 44. The input data is assigned to a storage location (address) in the memory of the programmable controller 44 where it is available for use in a preselected control program.

Analog input module 42 converts an analog signal from the position output of transducer 36 to a binary coded decimal value which is compared by the controller 44 with the preset thumbwheel input values to produce a binary coded output signal on line 64 to correct for variances of position values set by thumbwheel switches 46–50. The binary coded output signals are received by an analog output module 66 which converts the binary input to an analog output on a command signal line 68 to pilot valve amplifier circuit 40. The value of the output is determined by the velocity settings which were inserted in the memory of the programmable controller 44. The pilot valve amplifier circuit 40 also receives a velocity feedback signal from transducer 36. The velocity signal can be displayed by a velocity indicator 70 and is directed to amplifier circuit on line 72.

In one working embodiment, the analog input module 42 is an Allen-Bradley assembly, Catalogue Number 17711E; the DC input module 62 is an Allen-Bradley Catalogue Number 1771-1B; and the analog output module 66 is an Allen-Bradley Catalogue Number 1771-0F.

Figure 4:
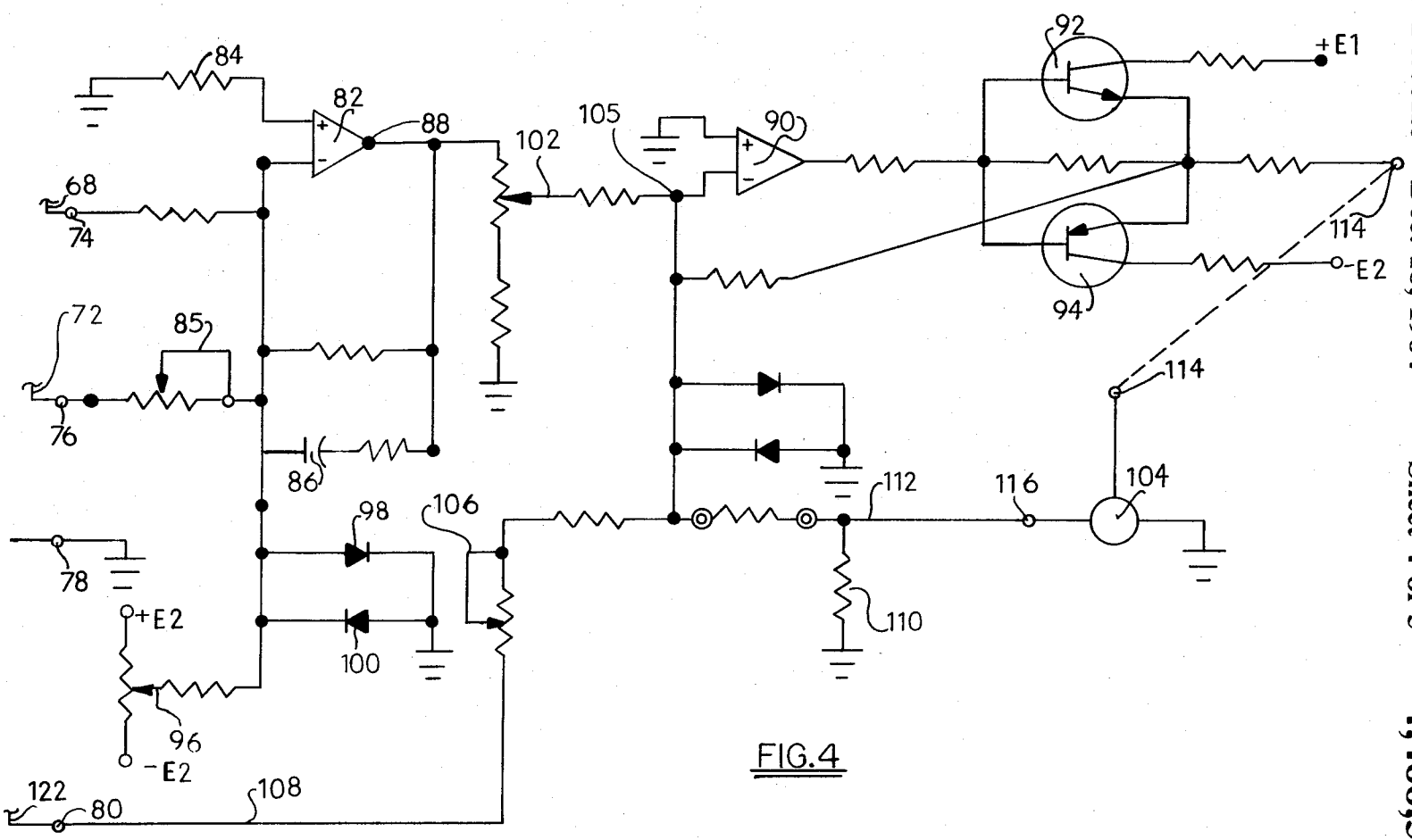
FIG. 4 is a wiring diagram of an amplifier circuit to produce a two-level control signal for a servo valve component in FIG. 2.

The pilot valve amplifier 40 is more specifically set forth in FIG. 4. It includes a command signal terminal 74 connected to line 68; a velocity feedback terminal 76; a common terminal 78 and a valve spool position feedback terminal 80. The terminal 76 receives signals from line 72 from transducer 36. Signals on lines 72,68 are connected to an input of operational amplifier 82. The input signals are connected to the negative input of amplifier 82 whose positive input is connected to ground through a reference resistor 84. Capacitor 86 is connected between the negative input of operational amplifier 82 and its terminal 88 so that amplifier 82 will provide integral control. Feedback gain on the velocity signal is set by potentiometer 85.

An operational amplifier 90 provides a current drive stage and a complementary pair of transistors 92,94 provide current boost. Potentiometer 96 provides a null bias control of the input signals with diodes 98,100 protecting operational amplifier 82 from runaway signals on the input lines. The servoloop gain is set by potentiometer 102 which is located after the input stage defined by operational amplifier 82 thereby to produce full gain control. The potentiometer 102 adjusts the output signal strength to a servo pilot valve 104 to establish valve response to the input signals.

The output of operational amplifier 82 is summed with the position feedback signal (terminal 80) at a junction 105 to the current drive stage defined by operational amplifier 90. A potentiometer 106 in signal line 108 provides inner loop gain. Resistor 110 connected between ground and output line 112 provides current feedback.

A resultant amplified output signal is produced at output terminals 114,116. Servo coils 118,120 of hydraulic servo pilot valve 104 are connected across terminals 114, 116. A spool position feedback signal is produced on line 122 from an LVDT Olmsted valve 124 to cause the amplifier circuit 70 to produce an on-off energization of the pilot valve 104.

Figure 2A:
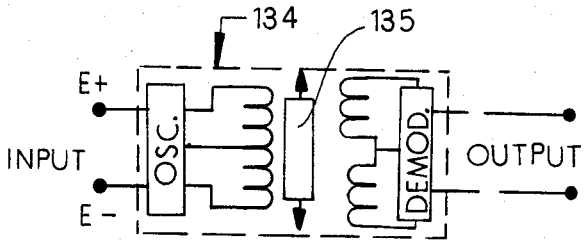
FIG. 2A is a circuit diagram of a linear voltage transducer in the system of FIG. 2.
Figure 2:
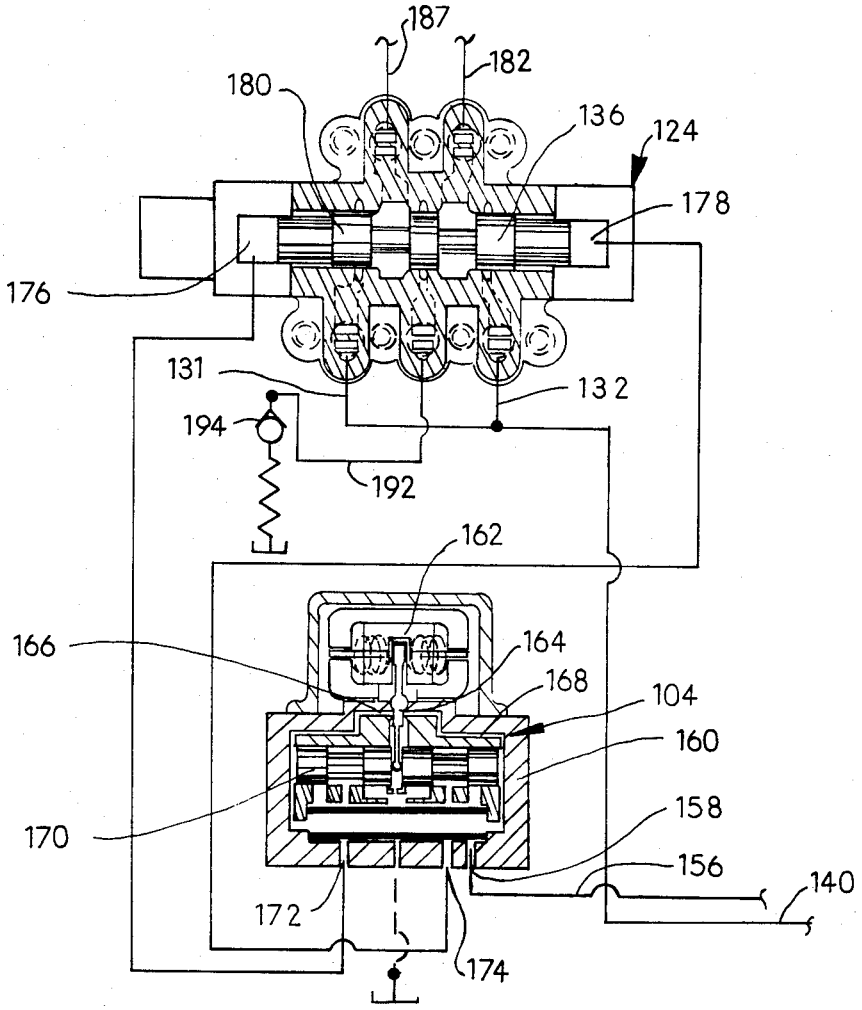
FIG. 2 is a diagrammatic view of the hydraulic system controlled by system of FIG. 1.
Figure 3:
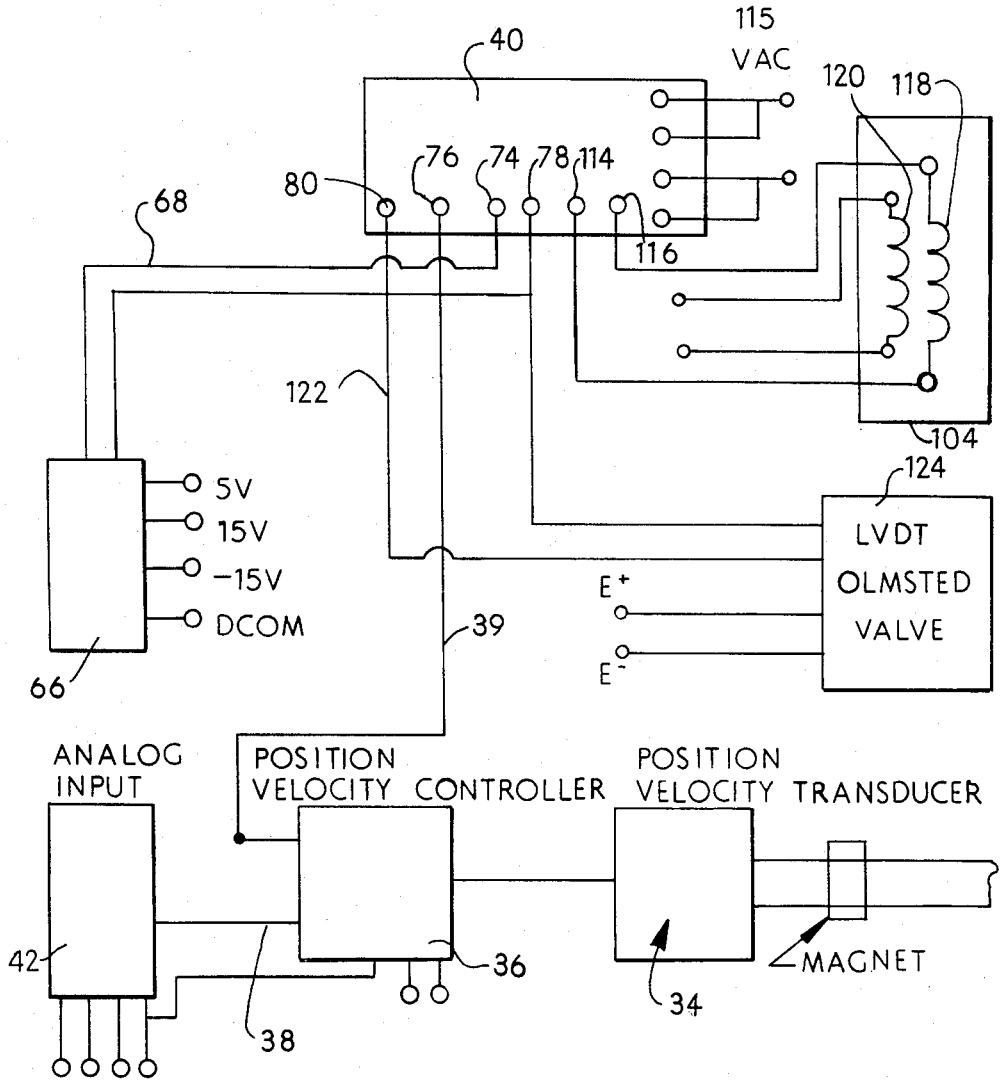
FIG. 3 is a wiring diagram of the interface between the electronic components and electrically controlled hydraulic valves of the present invention.
Figure 5:
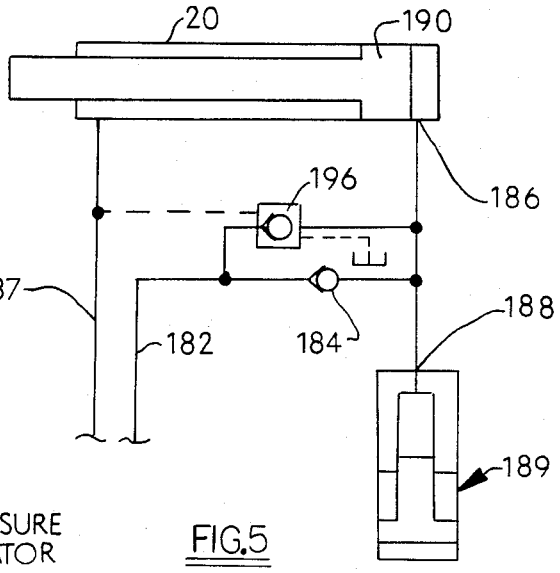
FIG. 5 is a diagram of a shot cylinder and hydraulic components for use with the system of FIG. 2.
Figure 6:
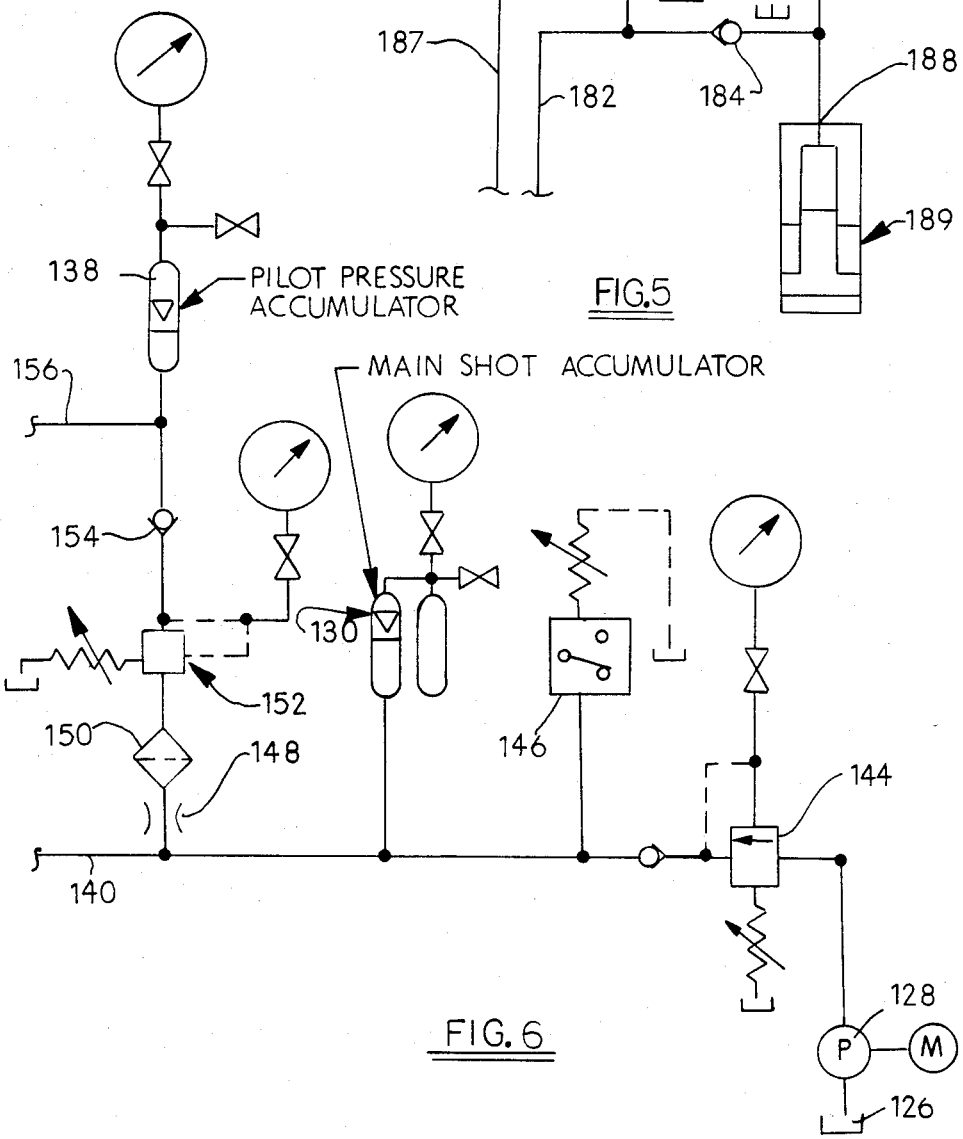
FIG. 6 is a diagram of accumulators and hydraulic components for use with the system of FIG. 2.

Referring now more specifically to FIGS. 2, 5 and 6, a servo system controlled by amplifier 40 controls a hydraulic supply or pressure medium from a tank or reservoir 126. A pump 128 directs the medium to a main shoot accumulator 130 and inlet conduits 131,132 to Olmsted valve 124 with a built-in linear voltage transducer (LVDT) 134 shown in FIG. 2A which has a plunger 135 driven by spool 136 to check spool motion at two points (can be set as close as 0.010 inches) to maintain a position signal at terminal 80 and a resultant modulated drive of valve spool 136 so that valve opening can be adjusted to maintain a desired preset speed rate of shot cylinder drive to compensate for machine operating variables such as changes in temperature of hydraulic fluid in the shot cylinder because of system operation.

The illustrated servo controlled hydraulic drive system includes a pilot pressure accumulator 138. More specifically, both accumulators 130,138 are connected to a supply conduit 140 from pump 128 across check valve 142. Pressure in accumulator 130 is regulated by a pressure reducing valve 144 set at a maximum accumulator pressure of 1800 psi. A pressure switch 146 in conduit 140 is set 50 psi below the pressure in accumulator 130. Pilot pressure is established by flow and pressure across a series connected orifice 148, filter 150, pressure reducing valve 152 and check valve 154 to charge the pilot pressure accumulator 138. Valve 152 is set at a maximum servo pressure of 1000 psi.

The pilot pressure accumulator 138 supplies a pilot pressure inlet line 156 to a pilot pressure inlet port 158 of a housing 160 for pilot control valve 104.

Valve 104 is a servo valve, Model No. A076 of Moog Inc., Industrial Division, East Aurora, New York. Such units are more specifically described in U.S. Pat. Nos. 3,023,782 and 3,228,423.

For purposes of the present invention it should be understood that an on-off control signal from amplifier circuit 40 causes either full clockwise or full counterclockwise torque on an armature 162 of valve 104. A flapper 164 is either fully closed or opened with respect to nozzles 166,168 to shift a pilot spool 170 in a snap movement to the right or left as viewed in FIG. 2. A built-in feedback torque will be produced by spool movement to return the flapper to a center position if there is no signal on the valve 104. However, the valve spool 170 will remain displaced in either a right or left position depending upon the state of the on-off amplifier signal.

The pressure controlled by flapper 164 is fed to the ends of spool 170. The second stage of the valve is a fourway spool design with outlet flow from ports 172,174 which are full opened or full closed as the flapper feeds the respective ends of spool 170.

The outlet ports 172,174 are connected, respectively, to the spool ends 176,178 of spool 180 of Olmsted valve 124. Valve 124 is a third stage shot valve with axial flow and a floating spool which is balanced dynamically as well as statically under high flow conditions. In one working embodiment the valve is a two-inch valve with a 2,000 gpm four-way spool and with a manifold mounted with LVDT. The on-off flow to either end of spool 180 causes the Olmsted valve 124 to modulate ±0.0001 inches on either side of the control point. Hence the valve 124, is not sensitive to hysteresis and operates without a null point and thereby establishes an extremely accurate flow of hydraulic fluid to establish a shot cylinder velocity that is compensated for changes in machine variables such as temperature of the hydraulic fluid which varies as the die casting machine is operated. In the illustrated system, modulated flow is through outlet 182, thence across check valve 184 to an inlet 186 at one end of the shot cylinder 20 or directly through line 187 to the opposite end of cylinder 20 depending upon whether the ram is advancing or retreating.

An intensifier connection 188 is connected to a multiplier cylinder 189 of conventional form well known to those skilled in die casting. Suitable connection to drain is provided from opposite sides of shot piston 190 through line 192 from valve 124.

During shot movement of piston 190 the spool 180 is positioned so that modulated hydraulic flow passes from valve 124 through line 182 to the right side of piston 190 as viewed in FIG. 5. Return flow of hydraulic fluid on the opposite side of piston 190 is through line 187, valve 124, and drain line 192 thence through check valve 194. During opposite retract movement of piston 190, the pressure line 187 is connected through modulating spool 136 to line 140. Return flow from the opposite side of piston 190 is through PO check valve 196 manufactured by RexRoth as Catalogue No. SL-30-P201/50134/5V; thence through line 182, to drain.

The operation of the system includes a known slow shot cycle in which known system hydraulics are conditioned to maintain a prefilling phase. Thereafter, a fast shot cycle is established for mold filling. During these operations the pressure acting on the shot piston 190 is substantially lower than the pressure prevailing in accumulator 130.

At the instant of final mold filling with the molten metal, the intensifier 189 is operative to cause the hydraulic pressure acting on piston 190 to increase rapidly.

During follow through, hydraulic means are provided to effect a post pressurization of the molten metal to be cast during the solidification period in the mold.

Following solidification, the shot cylinder is retracted.

The present invention is adaptable to a wide range of hydraulic systems and accordingly, for purposes of simplifying understanding of the invention, details of the intensifier circuit and other hydraulic components of known diecast machines are omitted.

The provision of the position velocity transducer 36 and its use to produce the above-described position and velocity control signals position to produce a command signal on line 68 and a velocity to produce a feedback signal on terminal 76 can be incorporated in known systems so long as the amplifier 40 drives the servo pilot valve 104 in proportion to the difference between the command and feedback signals. Further, the output of amplifier 40 is such that the pilot valve is conditioned on-off. The rate of the on-off control in turn establishes the degree of flow modulation produced by Olmsted valve 124 to maintain a desired shot cylinder ram speed (as pre-set by wheels 46-60) regardless of machine operating variables such as shot cylinder ram fit, cold metal and fluid velocity.

What we claim is:

1. A shot cylinder controller for regulating the velocity of a hydraulically operated shot cylinder ram of a die-casting machine to maintain a desired pre-set ram velocity profile comprising:

means located externally of the hydraulic supply system for sensing the velocity and position of the shot cylinder ram and for producing a separate actual ram velocity signal and an actual ram position signal; means for pre-setting a ram velocity profile of desired ram velocities for pre-determined ram positions;

means including a programmable computer having an input module for comparing the actual ram position signal with the preset ram position velocity and means to produce a command velocity signal from said programmable computer;

spool valve means having a spool and an LVDT signal generator to produce a spool position signal in accordance with spool movement;

pilot valve means having an armature driven spool means conditioned to assume opposite full-on flow positions in accordance with a full step positive or negative valve current drive signal;

control means including means for comparing said actual ram velocity signal with said command velocity signal to produce a ram velocity error signal; first amplifier means conditioned by said error signal to produce an output signal; second amplifier means conditioned by said output signal to produce a current boost stage signal; a current boost stage for producing opposite polarity full step valve current drive signals for selectively positioning said pilot valve means only in a full-on flow position when energized; and means responsive to said spool position signal for producing a signal to suppress said full step valve current drive signals to turn off said current boost stage when velocity errors are compensated;

said spool valve means being driven by reverse hydraulic flow from said pilot valve means to produce modulated flow from said spool valve means to the shot cylinder ram without reference to pilot valve null point and without reference to pilot valve hysteresis so as to control velocity of a shot cylinder ram to compensate for shot speed changes produced during operation of the die-casting machine.

* * * * *